US010755847B2

(12) United States Patent
Kim

(10) Patent No.: US 10,755,847 B2
(45) Date of Patent: Aug. 25, 2020

(54) COIL ELECTRONIC COMPONENT

(71) Applicant: SAMSUNG ELECTRO-MECHANICS CO., LTD., Suwon-si, Gyeonggi-do (KR)

(72) Inventor: Jae Hun Kim, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 124 days.

(21) Appl. No.: 15/818,151

(22) Filed: Nov. 20, 2017

(65) Prior Publication Data

US 2018/0261377 A1 Sep. 13, 2018

(30) Foreign Application Priority Data

Mar. 7, 2017 (KR) ..... 10-2017-0028671
Mar. 16, 2017 (KR) ..... 10-2017-0033269

(51) Int. Cl.
*H01F 27/32* (2006.01)
*H01F 27/28* (2006.01)
(Continued)

(52) U.S. Cl.
CPC ..... *H01F 27/2804* (2013.01); *H01F 17/0013* (2013.01); *H01F 27/255* (2013.01);
(Continued)

(58) Field of Classification Search
CPC ..... H01F 17/0013; H01F 17/0073; H01F 2017/048; H01F 27/2804; H01F 27/323;
(Continued)

(56) References Cited

U.S. PATENT DOCUMENTS 6,452,742 B1 * 9/2002 Crue ..... G11B 5/313 360/123.31
7,307,503 B2 * 12/2007 Kaji ..... H01F 17/0006 257/E21.022
(Continued)

FOREIGN PATENT DOCUMENTS

CN 104700982 A 6/2015
CN 104766691 A 7/2015
(Continued)

OTHER PUBLICATIONS

Notice of Office Action issued in KR Patent Application No. 10-2017-0033269, dated Apr. 3, 2018 with English translation.
(Continued)

*Primary Examiner* — Mang Tin Bik Lian
(74) *Attorney, Agent, or Firm* — Morgan, Lewis & Bockius LLP

(57) ABSTRACT

A coil electronic component includes a support member and a plurality of insulating patterns supported by the support member. Each of the plurality of insulating patterns includes an innermost insulating pattern adjacent to a through-hole of the support member, an outermost insulating pattern on the opposing side of the insulating patterns, and a plurality of central insulating patterns between the innermost insulating pattern and the outermost insulating pattern. At least one of the plurality of central insulating patterns has its largest width at a lower surface thereof where it is in contact with the support member.

22 Claims, 12 Drawing Sheets

(51) Int. Cl.

| | |
|---|---|
| ***H01F 41/04*** | (2006.01) |
| ***H01F 27/255*** | (2006.01) |
| ***H01F 41/12*** | (2006.01) |
| ***H01F 27/29*** | (2006.01) |
| ***H01F 17/00*** | (2006.01) |
| *H01F 17/04* | (2006.01) |

(52) U.S. Cl.
CPC ..... *H01F 27/292* (2013.01); *H01F 27/324* (2013.01); *H01F 41/041* (2013.01); *H01F 41/125* (2013.01); *H01F 2017/048* (2013.01)

(58) Field of Classification Search
CPC .... H01F 27/324; H01F 27/255; H01F 27/292; H01F 41/125; H01F 41/041
USPC ..... 336/200, 233, 223, 199, 205, 192
See application file for complete search history.

(56) References Cited

U.S. PATENT DOCUMENTS

| | | | | |
|---|---|---|---|---|
| 2005/0184848 | A1* | 8/2005 | Yoshida | H01F 17/0013 336/223 |
| 2007/0222550 | A1 | 9/2007 | Fujiwara et al. | |
| 2008/0003408 | A1* | 1/2008 | Masai | H01F 17/0033 428/161 |
| 2013/0249664 | A1* | 9/2013 | Tonoyama | H01F 41/04 336/200 |
| 2014/0009254 | A1* | 1/2014 | Ohkubo | H01F 27/2804 336/192 |
| 2014/0292468 | A1* | 10/2014 | Motomiya | H01F 17/0013 336/200 |
| 2015/0035634 | A1* | 2/2015 | Nakamura | H01F 17/0013 336/170 |
| 2015/0048919 | A1 | 2/2015 | Diamanti et al. | |
| 2015/0102889 | A1 | 4/2015 | Choi et al. | |
| 2015/0155093 | A1 | 6/2015 | Kim et al. | |
| 2016/0351316 | A1* | 12/2016 | Ohkubo | H01F 17/0006 |
| 2017/0040101 | A1 | 2/2017 | Jeong | |

FOREIGN PATENT DOCUMENTS

| | | | | |
|---|---|---|---|---|
| JP | H03-97386 | U | | 10/1991 |
| JP | 09-252087 | A | | 9/1997 |
| JP | 2001-203109 | A | | 7/2001 |
| JP | 2007-266105 | A | | 10/2007 |
| JP | 2015-076603 | A | | 4/2015 |
| JP | 2015-216336 | A | | 12/2015 |
| JP | 2017-017139 | A | | 1/2017 |
| JP | 2017-017140 | A | | 1/2017 |
| JP | 2017017139 | A | * | 1/2017 |
| KR | 10-1999-0066108 | A | | 8/1999 |
| KR | 10-2004-0100945 | | | 12/2004 |
| KR | 10-2015-0019588 | A | | 2/2015 |
| KR | 10-2017-0017480 | A | | 2/2017 |

OTHER PUBLICATIONS

Notice of Office Action issued in Japanese Patent Application No. 2017-223889, dated Aug. 7, 2018 (English abstract).
Notice of Office Action issued in U.S. Patent Application No. 10-2017-0033269, dated Apr. 3, 2018 with English translation.
Office Action issued in corresponding Chinese Patent Application No. 201810042232.1, dated Sep. 29, 2019.

* cited by examiner

COIL ELECTRONIC COMPONENT

CROSS-REFERENCE TO RELATED APPLICATION(S)

This application claims benefit of priority to Korean Patent Application Nos. 10-2017-0028671 filed on Mar. 7, 2017 and 10-2017-0033269 filed on Mar. 16, 2017 in the Korean Intellectual Property Office, the disclosure of which is incorporated herein by reference in its entirety.

BACKGROUND

1. Field

The present disclosure relates to a coil electronic component, and more particularly, to a power inductor with a small size and high inductance.

2. Description of Related Art

In accordance with the development of information technology (IT), electronic devices and components have been rapidly miniaturized and thinned. Therefore, market demand for small, thin devices has increased.

Korean Patent Laid-Open Publication No. 10-1999-0066108 provides a power inductor including a substrate having a via hole and coils disposed on opposite surfaces of the substrate and electrically connected to each other through the via hole in the substrate, in accordance with technical trends to obtain an inductor with coils having a uniform thickness and a high aspect ratio. However, the manufacturing process still limits the ability to achieve a uniform thickness and a high aspect ratio.

SUMMARY

An aspect of the present disclosure may provide an inductor capable of addressing the limitations described above and being stable and reliable in terms of an overall structure, in spite of including a coil having a high aspect ratio.

According to an aspect of the present disclosure, a coil electronic component may include a body and external electrodes disposed on external surfaces of the body. The body may include a plurality of coil patterns, a plurality of insulating patterns between adjacent coil patterns of the plurality of coil patterns, an insulation coating portion in contact with upper surfaces of the coil patterns, and a support member supporting the coil patterns and the insulating patterns. Each of the plurality of insulating patterns may include an outermost insulating pattern, an innermost insulating pattern, and a plurality of central insulating patterns between the outermost insulating pattern and the innermost insulating pattern. One or more of the plurality of central insulating patterns may have a largest width, in a crosssectional view of a thickness direction, where the central insulating pattern is in contact with the support member. The central insulating patterns may include one or more change portions, between their uppermost and lowermost surfaces, where the width changes.

According to another aspect of the present disclosure, a coil electronic component may include a support member, a plurality of coil patterns supported by the support member and connected to each other, and insulating portions supported by the support member and coating both side and upper surfaces of the coil patterns. Side surface insulating portions coating the side surfaces of the coil patterns may be configured integrally with upper surface insulating portions coating the upper surface of the coil patterns. The width of the lower surfaces of the side surface insulating portions may be the largest where they are in contact with the support member.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, coil components according to exemplary embodiments in the present disclosure will be described. However, the present disclosure is not necessarily limited thereto.

Figure 1:
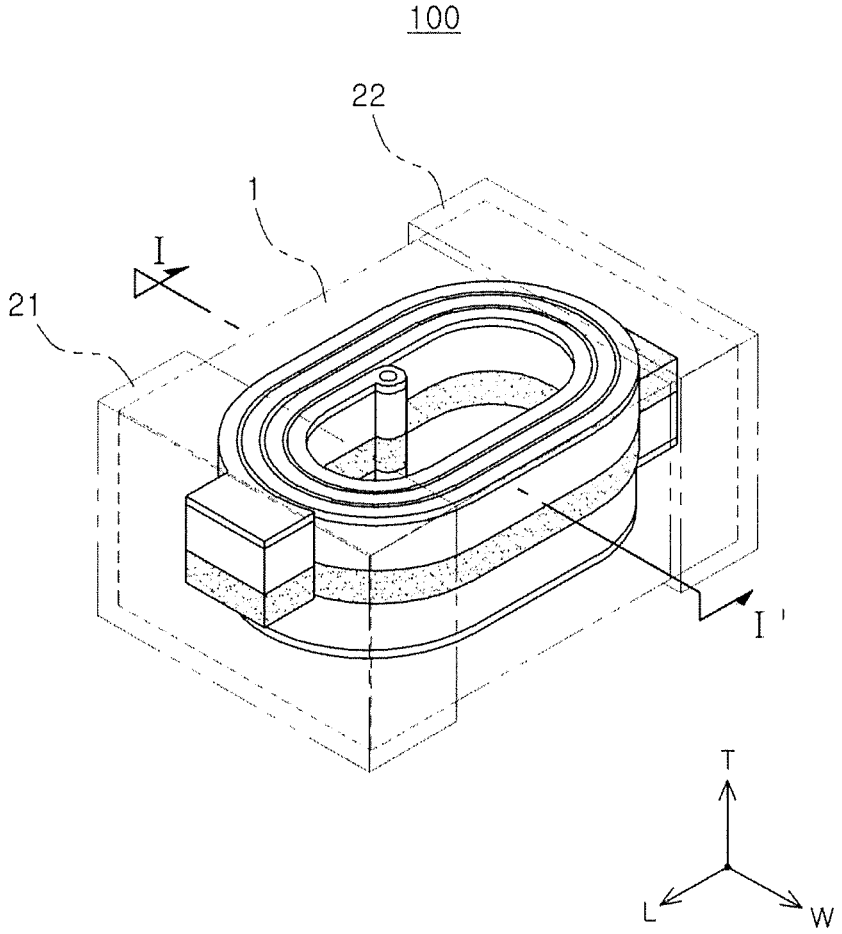
FIG. 1 is a schematic perspective view illustrating a coil electronic component according to an exemplary embodiment in the present disclosure.

FIG. 1 is a schematic perspective view illustrating a coil electronic component according to an exemplary embodiment in the present disclosure. Although FIG. 1 illustrates an inductor, the present disclosure is not limited thereto, and may be widely applied to components that include coils.

Referring to FIG. 1, the coil electronic component 100 may include a body 1, with a first external electrode 21 and a second external electrode 22 on external surfaces of the body 1.

The body 1 may have an upper surface and a lower surface opposing each other in a thickness direction (T), a first end surface and a second end surface opposing each other in a length direction (L), and a first side surface and a second side surface opposing each other in a width direction (W) to thus substantially have a hexahedral shape. However, the shape of the body 1 is not limited thereto. The body 1 may include a magnetic material having a magnetic property. For example, the magnetic material in the body 1 may be ferrite or metal magnetic particles filled in a resin, and the metal magnetic particles may include one or more selected from the group consisting of iron (Fe), silicon (Si), chromium (Cr), aluminum (Al), and nickel (Ni).

Figure 2:
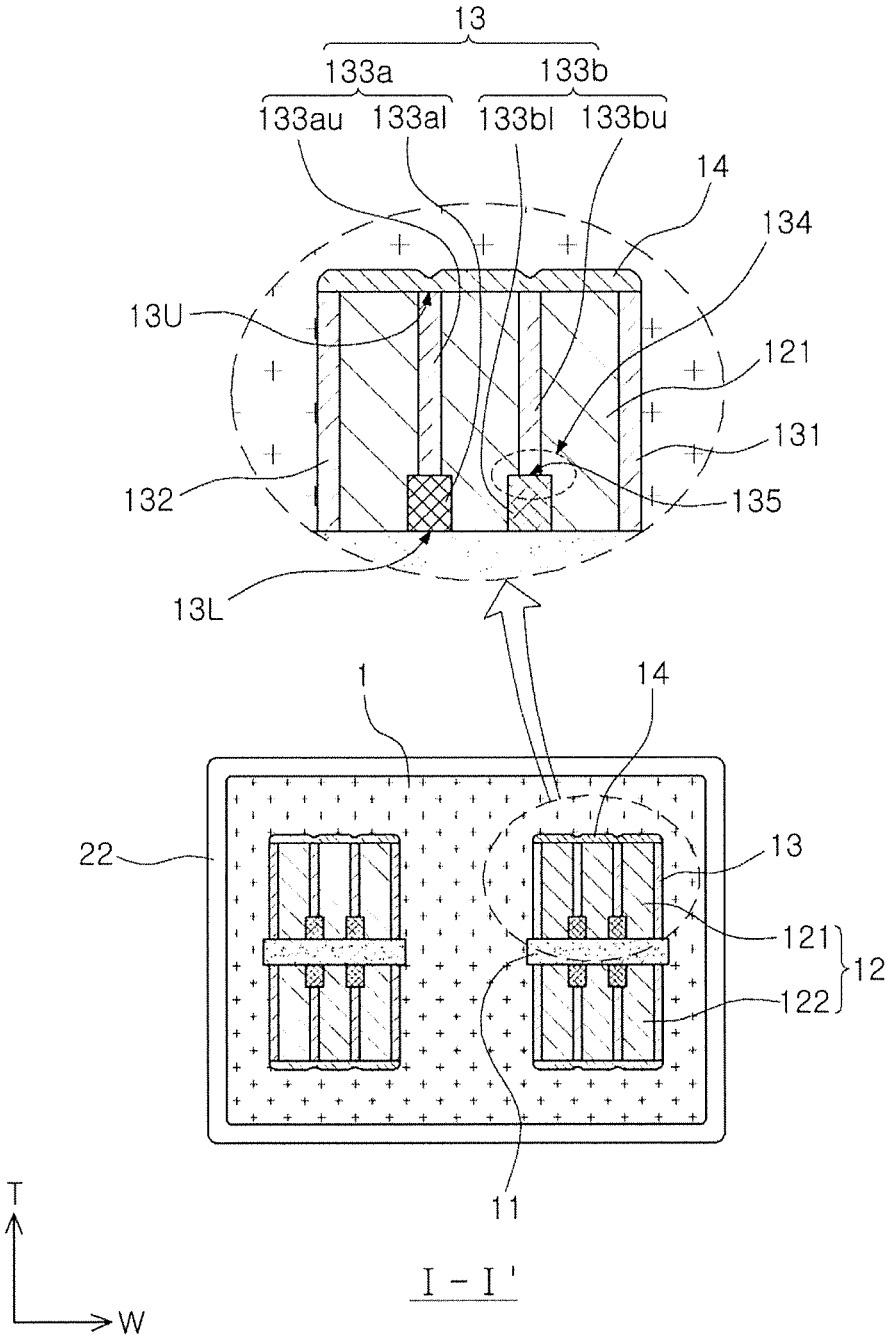
FIG. 2 is a cross-sectional view taken along line I-I' of FIG. 1.

FIG. 2 is a cross-sectional view taken along line I-I' of FIG. 1. An internal structure of the body of FIG. 1 will be described in more detail with reference to FIG. 2.

Referring to FIG. 2, a support member 11, a plurality of coil patterns 12 supported by the support member, a plurality of insulating patterns 13 supported by the support member, and an insulation coating portion 14 in contact with upper surfaces of the coil patterns may be included in the body 1.

The plurality of coil patterns 12 may be continuously connected to each other to constitute one coil, and may include upper coil patterns 121 disposed on an upper surface of the support member and lower coil patterns 122 disposed on a lower surface of the support member. The upper coil patterns and the lower coil patterns may be electrically connected to each other by vias formed in the support member. The upper coil patterns may be connected to each other to be thus generally configured in a spiral shape, and the lower coil patterns may also be connected to each other to be thus generally configured in a spiral shape. However, the shapes of the upper and lower coil patterns are not limited thereto.

The support member 11 may be used to form the coil patterns supported by the support member 11 at a smaller thickness and more easily form the coil pattern. The support member may be an insulating substrate formed of an insulating resin. The insulating resin may be a thermosetting resin such as an epoxy resin, a thermoplastic resin such as a polyimide resin, a resin having a reinforcement material such as a glass fiber or an inorganic filler impregnated in the thermosetting resin and the thermoplastic resin, such as prepreg, Ajinomoto Build up Film (ABF), FR-4, a Bismaleimide Triazine (BT) resin, a photoimagable dielectric (PID) resin, or the like. Including glass fiber in the support member may lead to improved rigidity. A through-hole may be formed in a central portion of the support member, and may be filled with a magnetic material to form a core portion.

The through-hole may be formed in the central portion of the support member 11, and may be filled with the magnetic material to improve magnetic permeability of the coil electronic component.

The plurality of insulating patterns 13 supported by the support member may be disposed in a structure in which the coil patterns are filled between insulating patterns adjacent to each other. An aspect ratio of the insulating pattern, which is a ratio of a thickness of the insulating pattern to a width of the insulating pattern, may be approximately 20 or more.

A lower surface 13L of the insulating pattern 13, which is a surface at which the insulating pattern 13 is supported by the support member, may be in contact with the support member. An upper surface 13U of the insulating pattern 13, which is a surface opposing the lower surface 13L, may be in contact with the insulation coating portion 14 disposed on the upper surface 13U.

The insulating pattern 13 may include a plurality of insulating patterns. In detail, the insulating pattern 13 may include the outermost insulating pattern 131, the innermost insulating pattern 132, and a plurality of central insulating patterns 133*a* and 133*b* disposed between the outermost insulating pattern and the innermost insulating pattern. In the figures and exemplary embodiments, two central insulating patterns are shown for explanatory purposes. However, there could be any number of insulating patterns, including one insulating pattern or three or more insulating patterns.

In relation to the outermost insulating pattern 131 and the innermost insulating pattern 132, a width of the outermost insulating pattern may not substantially change along the thickness direction T of the body, and a width of the innermost insulating pattern may also not substantially change along the thickness direction T of the body.

In addition, there is no visible interface surface between a lower surface of the outermost insulating pattern and an upper surface of the outermost coil pattern, which means that the outermost insulating pattern may be formed from the lower surface thereof to the upper surface thereof by a single process. Likewise, there is no visible interface surface between a lower surface of the innermost insulating pattern and an upper surface of the innermost coil pattern.

Alternatively, the outermost insulating pattern and the innermost insulating pattern may be formed of a double layer. When the outermost insulating pattern and the innermost insulating pattern are formed of a double layer of an upper layer and a lower layer, the lower layer may include a photoimagable dielectric (PID) material that may be stripped by a stripping solution, for example, a photosensitive material including a cyclic ketone compound and an ether compound having a hydroxy group as main components. Here, the cyclic ketone compound may be, for example, cyclopentanone, and the ether compound having the hydroxy group may be, for example, polypropylene glycol monomethyl ether, or the like. However, the PID material is not limited thereto, but may be any material that may be easily stripped by the stripping solution. The upper layer disposed on the lower layer may include a permanent type PID material, for example, a photosensitive material including a bisphenol-based epoxy resin as a main component. The outermost insulating pattern and the innermost insulating pattern may also be formed of a single layer. In this case, the single layer may include, for example, a bisphenol-based epoxy resin as a permanent type PID material.

Next, in relation to the plurality of central insulating patterns 133*a* and 133*b* disposed between the outermost insulating pattern and the innermost insulating pattern, one or more of the plurality of central insulating patterns 133*a* and 133*b* may a portion with a larger width in contact with the support member and may include one or more change portions 134 between the lower surface and upper surface of the central insulating pattern where the width changes.

Boundary surfaces 135 may be included in the change portions 134 in the central insulating patterns 133*a* and 133*b*, which means that the central insulating patterns may be visibly divided into lower central insulating patterns 133*al* and 133*bl* and upper central insulating patterns 133*au* and 133*bu* on the basis of the boundary surfaces. Here, the lower central insulating patterns may include the lower surfaces of the central insulating patterns in contact with the support member, and may have a width larger than that of the upper central insulating patterns. Therefore, when the central insulating patterns are supported by the support member, an aspect ratio of the central insulating patterns may be large, which can significantly reduce the risk of warpage or collapse of the central insulating pattern. The lower central insulating patterns by which the support member and the central insulating patterns are connected to each other may be configured to have the widths larger than those of the upper central insulating patterns to thus provide the coil electronic component reliable in terms of a structure without increasing an entire size of a chip.

In the lower central insulating patterns 133*al* and 133*bl*, corresponding to lower portions of the central insulating patterns on the basis of the boundary surfaces 135 in the central insulating patterns, widths may be substantially constant in the thickness direction, and may be the same as those at the lower surfaces of the lower central insulating patterns, that is, where the central insulating pattern is in contact with the support member.

Likewise, in the upper central insulating patterns 133*au* and 133*bu* corresponding to upper portions of the central insulating patterns on the basis of the boundary surfaces 135 in the central insulating patterns, widths may be substantially constant in the thickness direction, and may be smaller than those at the lower surfaces of the lower central insulating patterns, that is, the where the central insulating pattern is in contact with the support member.

The thicknesses of the upper central insulating patterns of the central insulating patterns may be two to twenty times the thicknesses of the lower central insulating patterns. When the thicknesses of the upper central insulating patterns are less than two times the thicknesses of the lower central insulating patterns limits the ability to implement insulating patterns with a high aspect ratio, and reduces the spaces in which the coil patterns adjacent to the lower central insulating patterns may be filled because of the widths of the insulating patterns to thus have a negative influence on Rdc characteristics. On the other hand, when the thicknesses of the upper central insulating patterns are larger than twenty times the thicknesses of the lower central insulating patterns, the relative thicknesses of the lower central insulating patterns may not be sufficient to ensure structural stability.

Meanwhile, a plurality of coil patterns 121 and 122 may be disposed between the outermost insulating pattern 131, the innermost insulating pattern 132, with the plurality of central insulating patterns 133*a* and 133*b* disposed between the outermost insulating pattern and the innermost insulating pattern. Side surfaces of the respective coil patterns may be in contact with side surfaces of insulating patterns adjacent to the respective coil patterns. The plurality of coil patterns may be continuously connected to each other to be thus generally configured in a spiral shape. However, the shape of the plurality of coil patterns is not limited thereto and may be appropriately designed by those skilled in the art.

The outermost insulating pattern, the innermost insulating pattern, and the plurality of central insulating patterns may be connected to each other to generally form an insulating wall having a plurality of openings. In this case, the volumes of internal spaces of the plurality of openings in which the coil patterns are filled may not be the same as each other.

The central insulating patterns including one or more change portions 134 which are between the uppermost surfaces and the lowermost surfaces thereof and where the widths change among the central insulating patterns may be intermittently arranged in the insulating wall.

The insulation coating portion 14 may be adopted in order to insulation-coat surfaces of the coil patterns that are not insulated by the insulating patterns among surfaces of the coil patterns. The insulation coating portion may be disposed to surround upper portions of the coil patterns, upper surfaces of the insulating patterns, and side surfaces of the insulating patterns that are not in contact with the coil patterns but are externally exposed among side surfaces of the insulating patterns. The method of forming the insulation coating portion is not particularly limited, but may be, for example, a method of laminating an insulating sheet or a method of dipping a sheet in a paste including an insulating resin.

Although not illustrated, post-processing, for example, mechanical polishing, chemical etching, or the like, may be performed on the coil patterns and the insulating patterns adjacent to the coil patterns in order to reduce plating deviations between the coil patterns. A coil pattern may be plated on a level above an upper surface of an insulating pattern adjacent to the at least one coil pattern, such that there is a plating deviation between the at least one coil pattern and other coil patterns. When a plating deviation is generated, a portion of the at least one coil pattern may be removed to make the thicknesses of the plurality of coil patterns and the insulating patterns adjacent to the plurality of coil patterns uniform. In this case, the insulation coating portion may be disposed in order to insulate portions that are not insulated by the insulating patterns on upper surfaces of the coil patterns after the thicknesses are made to be uniform.

Figure 3:
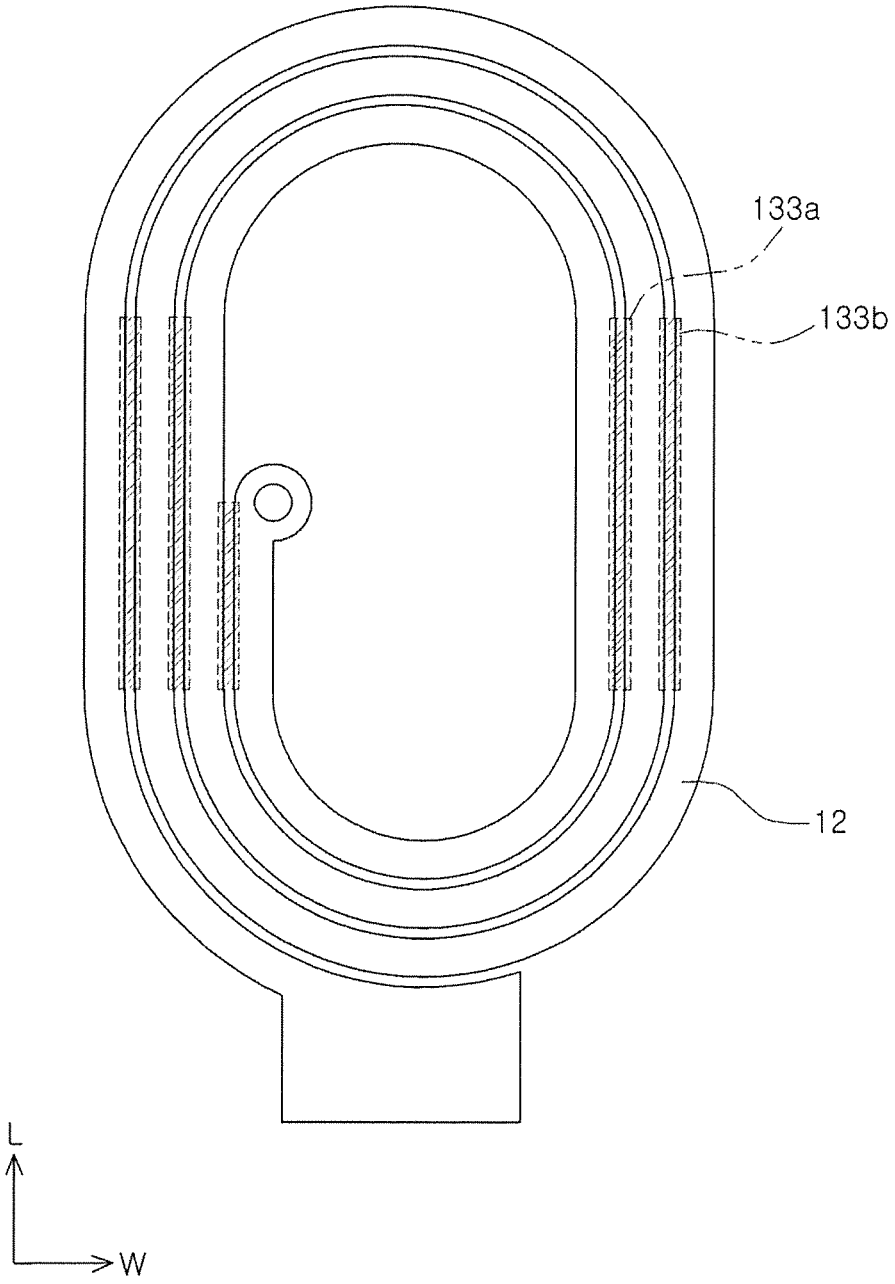
FIG. 3 is a schematic top view illustrating coil patterns and insulating patterns of FIG. 1.

FIG. 3 is a schematic top view illustrating coil patterns and insulating patterns of FIGS. 1 and 2. In FIG. 3, the insulation coating portion and magnetic materials encapsulating the coil patterns and the insulating patterns are omitted for convenience of explanation. In addition, for convenience of explanation, the lower portions of the central insulating patterns with larger widths are denoted by oblique lines.

Referring to FIG. 3, the plurality of coil patterns may be continuously connected to each other to be thus configured in a spiral shape, and the plurality of insulating patterns may also be continuously connected to each other to be thus configured in a spiral shape corresponding to that of the plurality of coil patterns. When the insulating patterns have larger widths in the lower surfaces thereof than in the upper surfaces thereof, the coil patterns adjacent to the insulating patterns may have smaller widths in lower surfaces thereof than in upper surfaces thereof.

FIG. 3 shows portions of the central insulating patterns denoted by the oblique lines mainly disposed particularly in straight line portions of the coil. The portions of the central insulating patterns denoted by the oblique line may include the change portions, and the boundary surfaces of the central insulating patterns may be included in the change portions. Therefore, the widths of the lower central insulating patterns corresponding to the lower portions of the central insulating patterns on the basis of the boundary surfaces of the change portions may be increased, such that the central insulating patterns may be more firmly attached to the support member, resulting in effective support of the straight line portions of the coil in which warpage or collapse of the insulating patterns is mainly generated.

Figure 4:
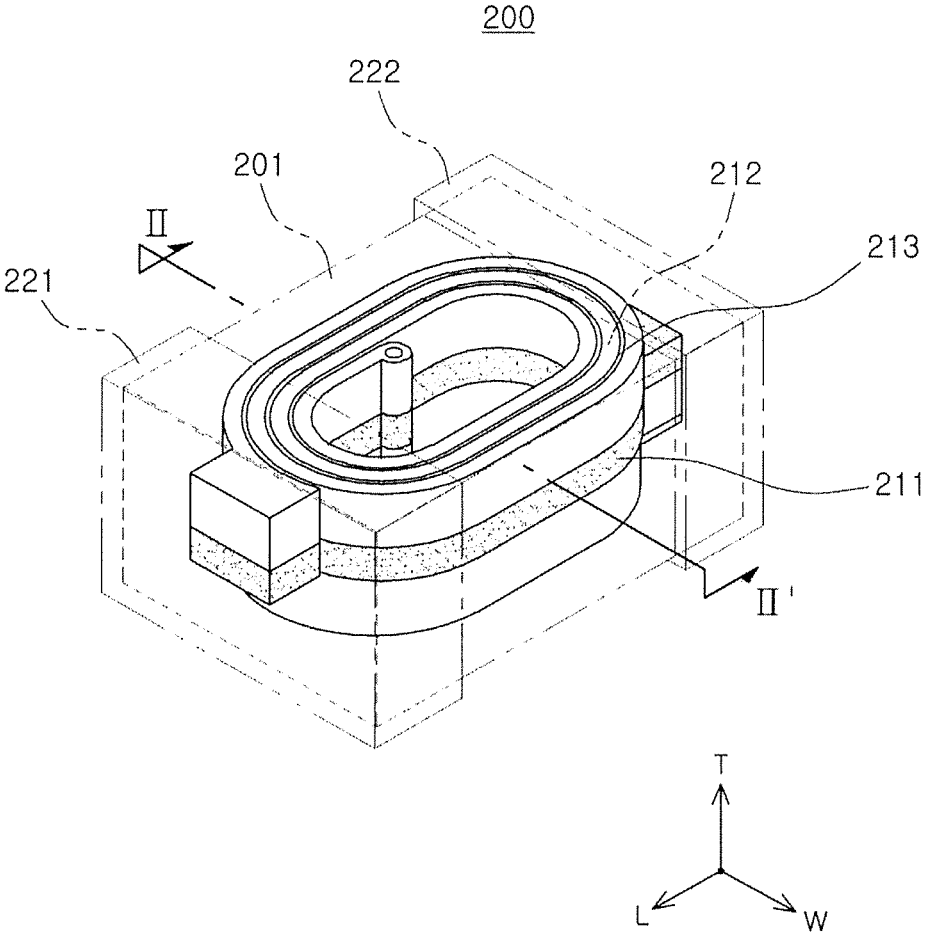
FIG. 4 is a schematic perspective view illustrating a coil electronic component according to another exemplary embodiment in the present disclosure.

FIG. 4 is a schematic perspective view illustrating a coil electronic component according to another exemplary embodiment in the present disclosure. The coil electronic component illustrated in FIG. 4 is different from the coil electronic component illustrated in FIG. 1 in that it includes an insulating portion integrally configured to coat both of the upper surfaces and the side surfaces of the coil patterns, instead of an insulation coating portion with a separate insulating material in contact with the upper surfaces of the coil patterns. An overlapping description of contents applicable to both the coil electronic component illustrated in FIG. 4 and the coil electronic component illustrated in FIG. 1 is omitted.

Figure 5:
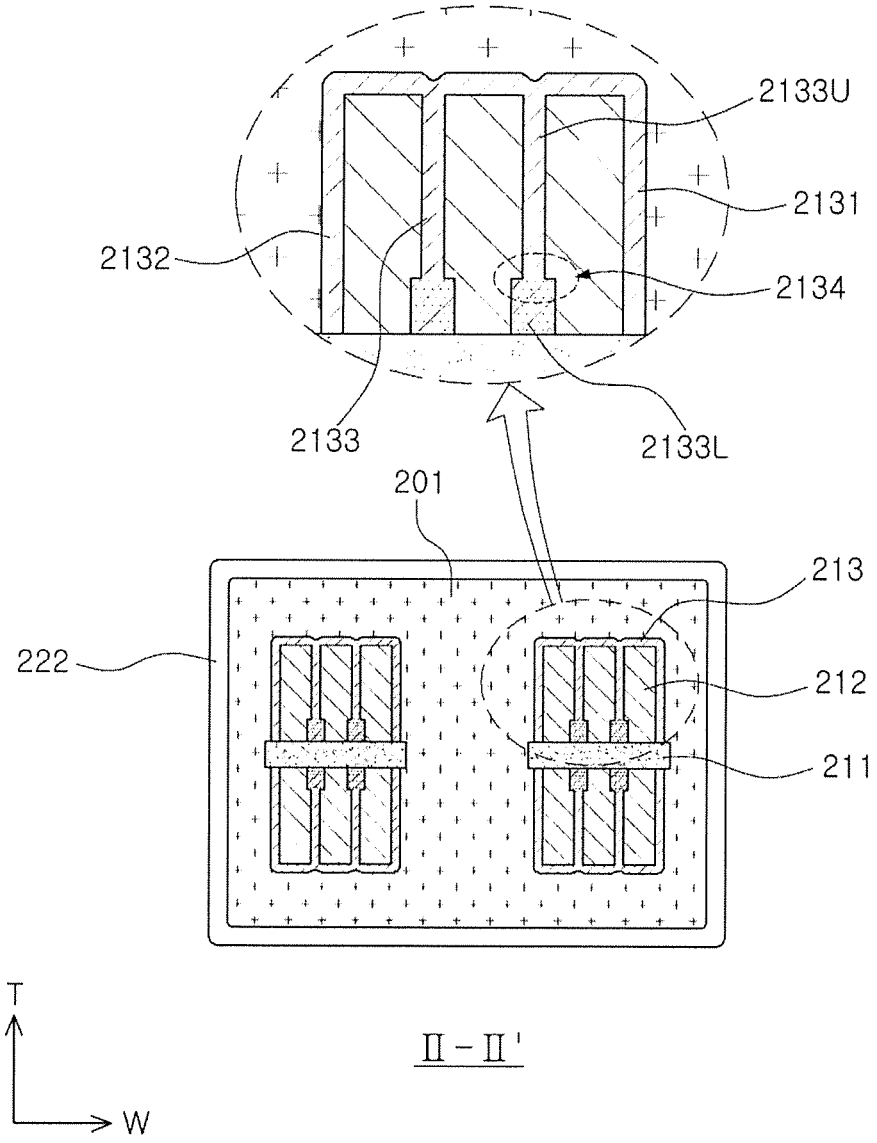
FIG. 5 is a cross-sectional view taken along line II-II' of FIG. 4.

Referring to FIGS. 4 and 5, the coil electronic component 200 may include a body 201 and first and second external electrodes 221 and 222 disposed on external surfaces of the body.

A support member 211, a plurality of coil patterns 212 supported by the support member, and insulating portions 213 supported by the support member may be included in the body 201.

The insulating portion 213 may be integrally configured to coat both the side surfaces and the upper surfaces of the coil patterns. The insulating portion 213 may include the outermost insulating portion 2131, the innermost insulating portion 2132, and central insulating portions 2133 disposed between the outermost insulating portion and the innermost insulating portion. In this case, all of the outermost insulating portion, the innermost insulating portion, and the central insulating portions may be connected to each other to generally form one insulating portion.

In addition, the support member and the insulating portion 213 supported by the support member may be encapsulated with a composite material including magnetic particles having a magnetic property and a resin.

FIG. 5 is a cross-sectional view taken along line II-II' of FIG. 4. Referring to FIG. 5, a lower surface of the insulating portion in contact with the support member of the insulating portion 213 coating the side surfaces and the upper surfaces of the coil patterns, may have the largest width of the portion of the insulating portion coating the side surfaces of the coil patterns. In this case, the insulating portion of which the lower surface has the largest width may be included in the central insulating portion 2133. On the other hand, each of the outermost insulating portion 2131 and the innermost insulating portion 2132 may have substantially constant widths in cross sections from the lowermost surfaces thereof in contact with the support member to the uppermost surfaces opposing the lowermost surfaces.

As described above, at least some of the central insulating portions may be configured to have the largest widths in the lower surfaces thereof in contact with the support member, and may include one or more change portions 2134 which are disposed between the lower surfaces and upper surfaces opposing the lower surfaces and in which widths of are reduced. The central insulating portions may be divided into upper central insulating portions 2133U disposed at upper portions of the central insulating portions and lower central insulating portions 2133L disposed at lower portions of the central insulating portions on the basis of the change portions.

The change portions 2134 may be intermittently arranged in the central insulating portions, and due to the change portions, areas of the lower surfaces of the central insulating portions in contact with the support member may be widely secured and spaces in which the coil patterns may be filled may be sufficiently secured. Therefore, structural reliability of the coil electronic component may be improved, such that problems such as a short-circuit, and the like, of the coil may be suppressed and a high aspect ratio of the coil may be secured.

In addition, the change portions 2134 may be arranged anywhere in the central insulating portions. In this case, the change portions 2134 may be arranged in straight line sections of a coil portion having a spiral shape, formed by generally connecting the plurality of coil patterns to each other. The reason is that the coil portion having the spiral shape includes the straight line sections and curved line sections that are alternately disposed and warpage or collapse of the insulating portions is more frequently generated in the straight line sections than in the curved line sections. Therefore, when the insulating portions including the change portions are disposed in the straight line sections, the support member may more stably support the insulating portions in the straight line section to remove a risk of a short-circuit between the coil patterns or a risk that the insulating portions will structurally collapse.

Figure 6:
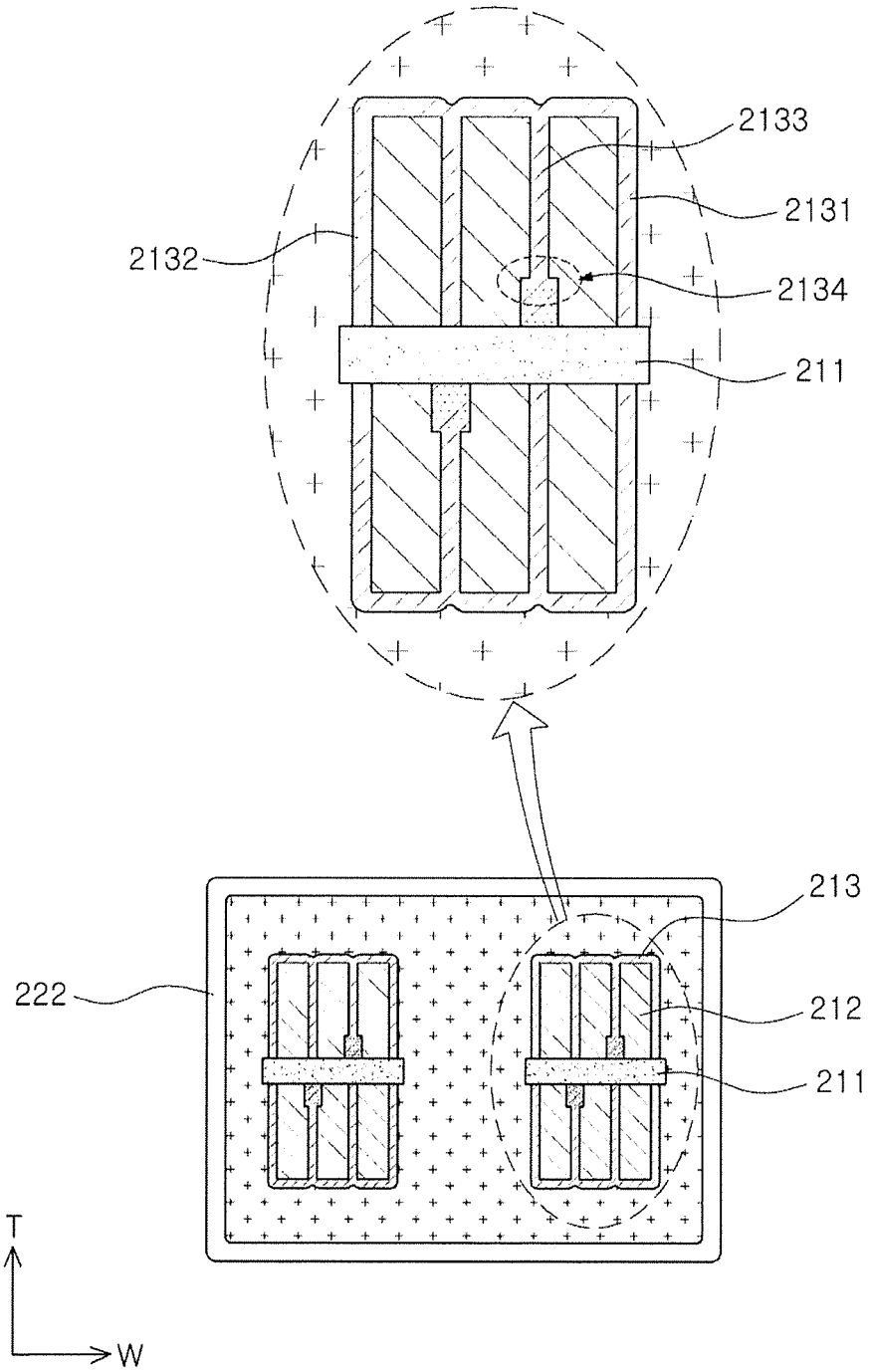
FIG. 6 is a schematic cross-sectional view illustrating a modified example of the coil electronic component of FIG. 4.

FIG. 6 is a schematic cross-sectional view illustrating a modified example of the cross-sectional view of FIG. 5. FIG. 6 illustrates a coil electronic component that is substantially the same as that illustrated in FIG. 5 except for an arrangement of at least one change portion 2134 in central insulating portions 2133.

Referring to FIG. 6, change portions 2134 may be alternately arranged on and beneath the support member. An arrangement of the change portions is not limited to the example illustrated in FIG. 6, and may be appropriately designed and modified by those skilled in the art in order to allow the support member to stably support insulating portions having a high aspect ratio. In addition, the positions of the change portions in the thickness direction, in other words, the positions at which central insulating portions are divided into upper central insulating portions and lower central insulating portions, may be appropriately designed and modified by those skilled in the art. Therefore, the ratio of the width of the lower central insulating portions to the width of the upper central insulating portions may be appropriately designed and modified by those skilled in the art. Further, the change portions need not have an shape with an abrupt change in width, as illustrated in FIG. 6, and instead may be designed and modified to have side surfaces with a curved shape or a stair shape although not illustrated.

Figure 7:
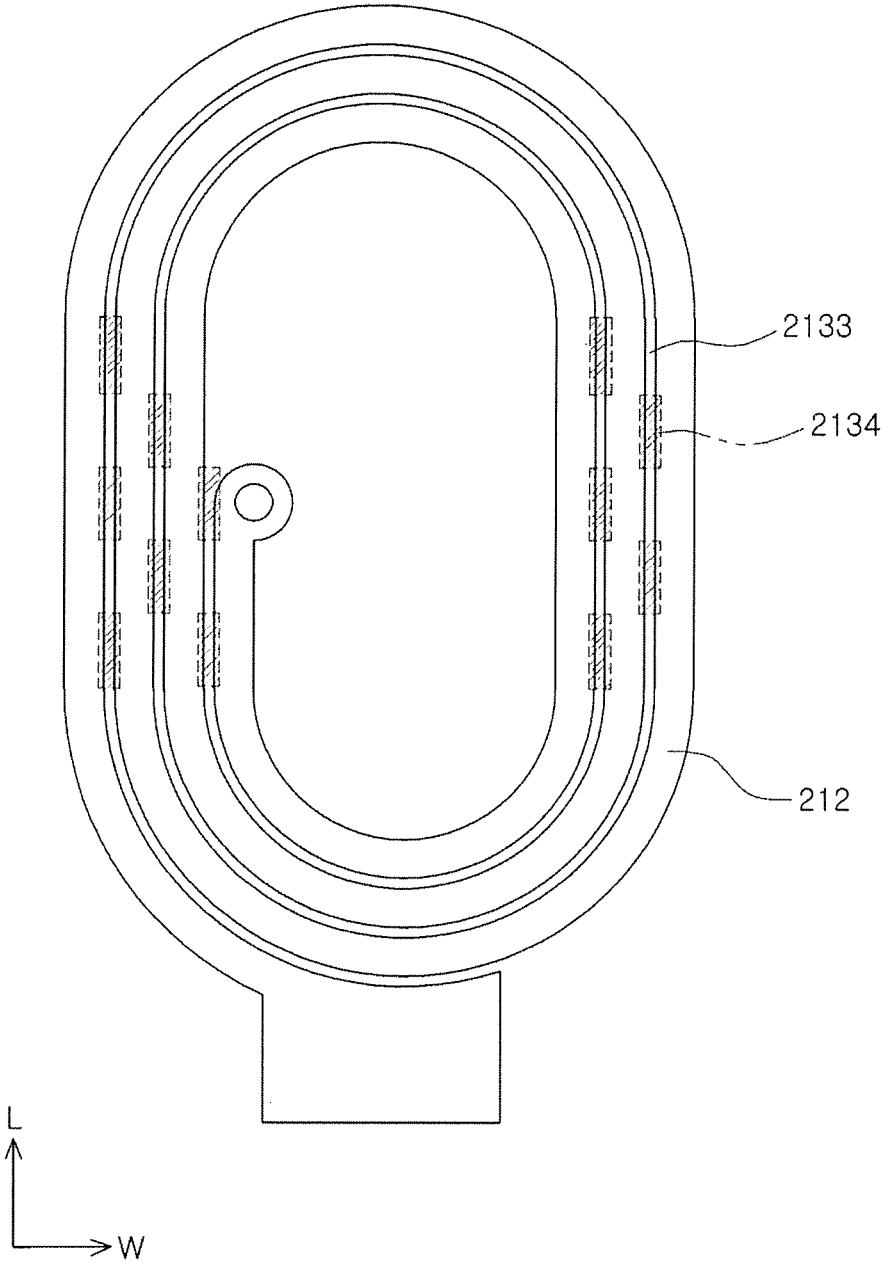
FIG. 7 is a schematic top view illustrating another modified example of the coil electronic component of FIG. 4.

FIG. 7 is a schematic top view illustrating another modified example of the coil electronic component of FIG. 4. In FIG. 7, central insulating patterns having larger widths in lower surfaces thereof, where they are in contact with the support member, than in upper surfaces thereof are denoted by oblique lines.

Referring to FIG. 7, the plurality of coil patterns may be continuously connected to each other to be thus configured in a spiral shape, and the plurality of insulating patterns may also be continuously connected to each other to be thus configured in a spiral shape corresponding to that of the plurality of coil patterns. When the insulating patterns have larger widths in the lower surfaces thereof than in the upper surfaces thereof, the coil patterns adjacent to the insulating patterns may have smaller widths in lower surfaces thereof than in upper surfaces thereof.

Referring to FIG. 7, it may be appreciated that portions of the central insulating patterns denoted by the oblique lines are intermittently arranged over the entirety of the central insulating patterns. This shows that those skilled in the art may freely control positions of the central insulating patterns enlarging cross-sectional areas of lower central insulating patterns among the central insulating patterns in consideration of both of a manufacturing environment and an aspect ratio of each insulating pattern as compared to a chip size of a final coil electronic component.

FIGS. 8A through 8J are views illustrating an exemplary manufacturing method for the coil electronic component 100 of FIG. 1 and the coil electronic component 200 of FIG. 4. The coil electronic component of FIG. 4 involves the same manufacturing processes as those of the coil electronic component of FIG. 1, except that the insulating patterns disposed on the side surfaces of the coil patterns and the insulation coating portion disposed on the upper surfaces of the coil patterns are connected to each other to be thus configured integrally with each other. Therefore, manufacturing process steps used for the coil electronic component 200 of FIG. 4 will be described with reference to FIGS. 8I and 8J. In addition, for convenience of explanation, reference numerals used in FIGS. 8A through 8J are the same as those used in the coil electronic component of FIG. 1.

Figure 8A:
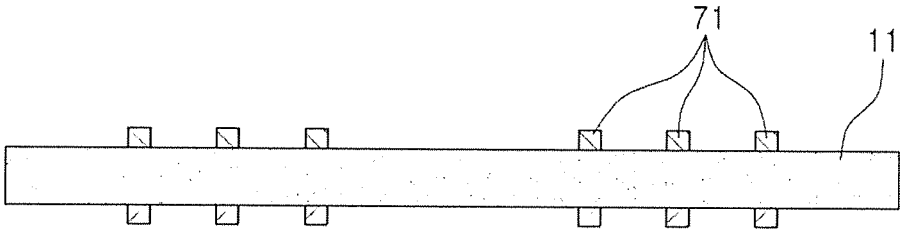
FIGS. 8A through 8J are views illustrating an exemplary manufacturing process for the coil components of FIGS. 1 and 4.

As illustrated in FIG. 8A, seed patterns 71 may be formed on opposing surfaces of the support member 11, respectively. The seed patterns may have conductor patterns generally having a coil shape. The seed patterns may be formed by a known method such as chemical vapor deposition (CVD), physical vapor deposition (PVD), sputtering, or the like, using a dry film, or the like, but is not limited thereto.

Optionally, the through-hole penetrating through the central portion of the support member may be formed by a laser beam, mechanical drilling, or the like, before the seed patterns are plated.

Figure 8B:
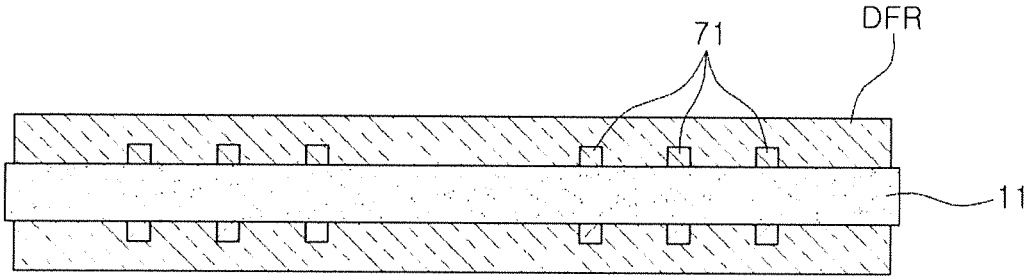

Referring to FIG. 8B, first resists DFR may be laminated, respectively, on the opposing surfaces of the support member on which the seed patterns were formed. The first resist may be laminated, for example, by a hot press process of pressing the first resist for a predetermined time at a high temperature, decompressing the first resist and then cooling the first resist to room temperature, and cooling the first resist in a cold press. A separating a work tool, or the like, may then be used. A hardening process may be performed after the lamination. The hardening process may be a process of drying the first resist so as not to be completely hardened in order to use a photolithography method, or the like.

Figure 8C:
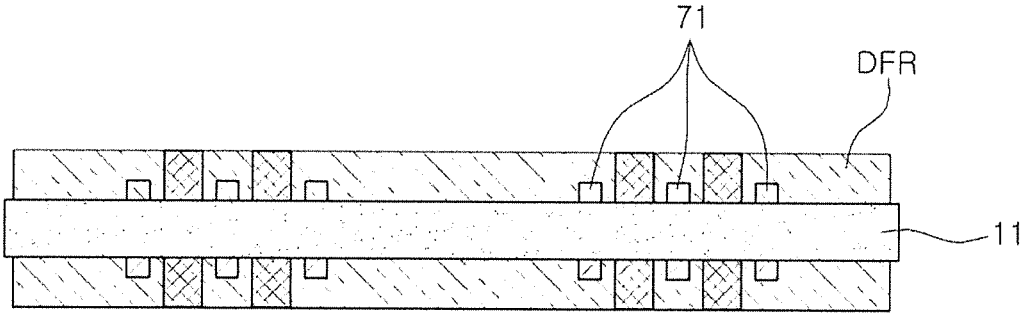

Referring to FIG. 8C, a primary exposing process may be performed in order to form the lower central insulating patterns of the central insulating patterns. The first resists may be patterned, and the patterning method may be appropriately selected depending on photosensitive characteristics of the first resists. In this case, the entirety of the central insulating patterns is not formed. The lower central insulating patterns, which are portions of the central insulating patterns, are formed. Thus, the thickness of the first resist may not be high.

Figure 8D:
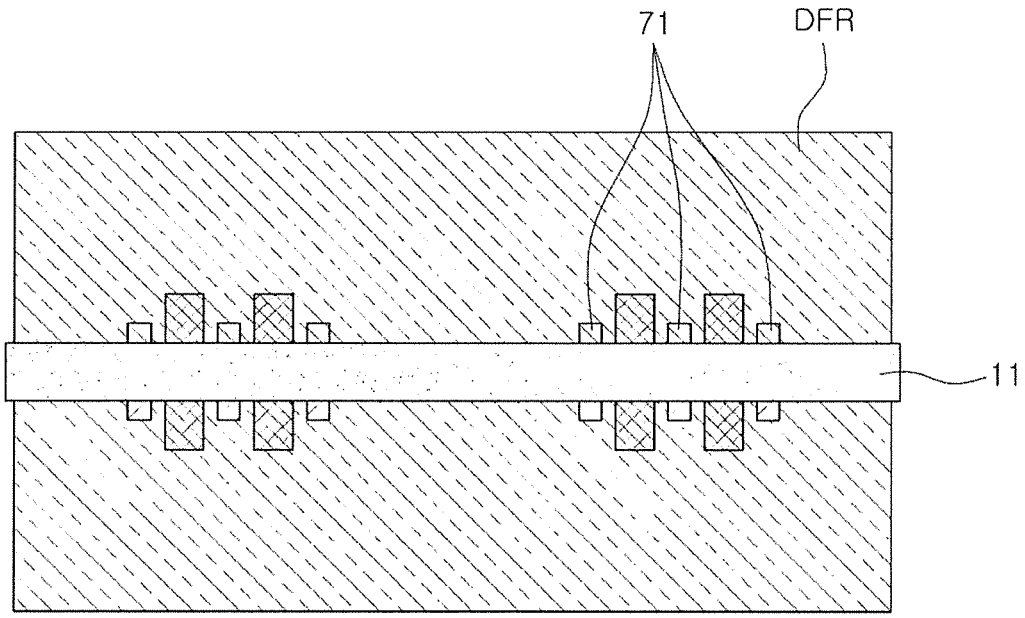

Referring to FIG. 8D, second resists DFR having a thickness corresponding to that of the final central insulating pattern may be laminated. The method of laminating the second resist may be substantially the same as the method of laminating the first resist. The second resists may be laminated to be in contact with the upper and lower surfaces of the support member, as well as portions between the lower central insulating patterns.

Figure 8E:
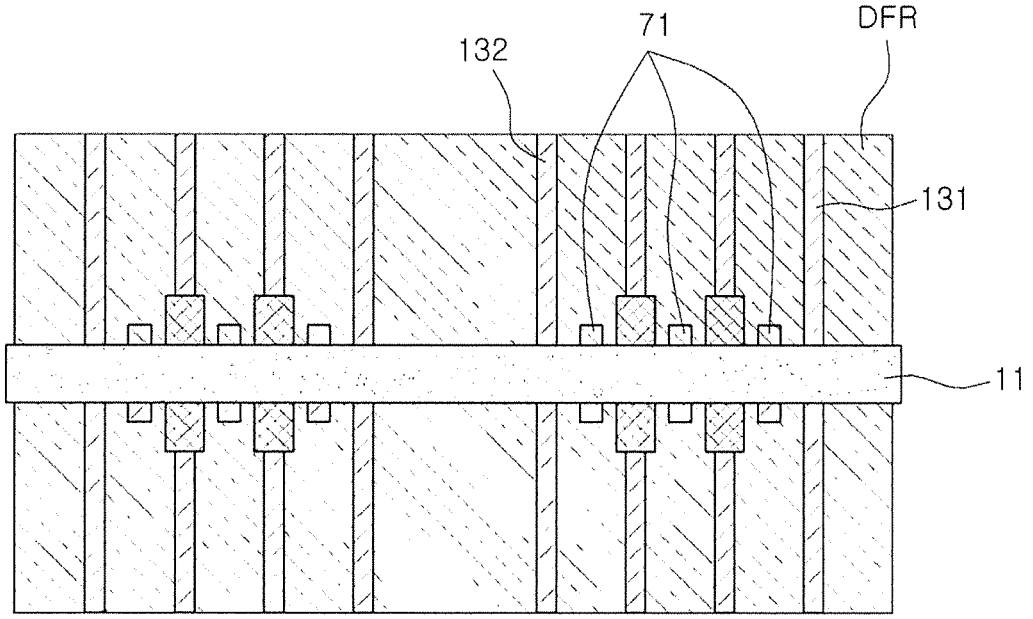

Referring to FIG. 8E, a secondary exposing process may be performed in order to form the outermost insulating pattern, the innermost insulating pattern, and the upper central insulating patterns of the central insulating patterns. The second resists may be patterned, and the patterning method may be appropriately selected depending on photosensitive characteristics of the second resists. Since the innermost insulating pattern, the outermost insulating pattern, and the entirety of the upper central insulating patterns of the central insulating patterns are formed, an aspect ratio of each insulating pattern determined through the secondary exposing process may be substantially the same as that of the insulating patterns of the final product.

Figure 8F:
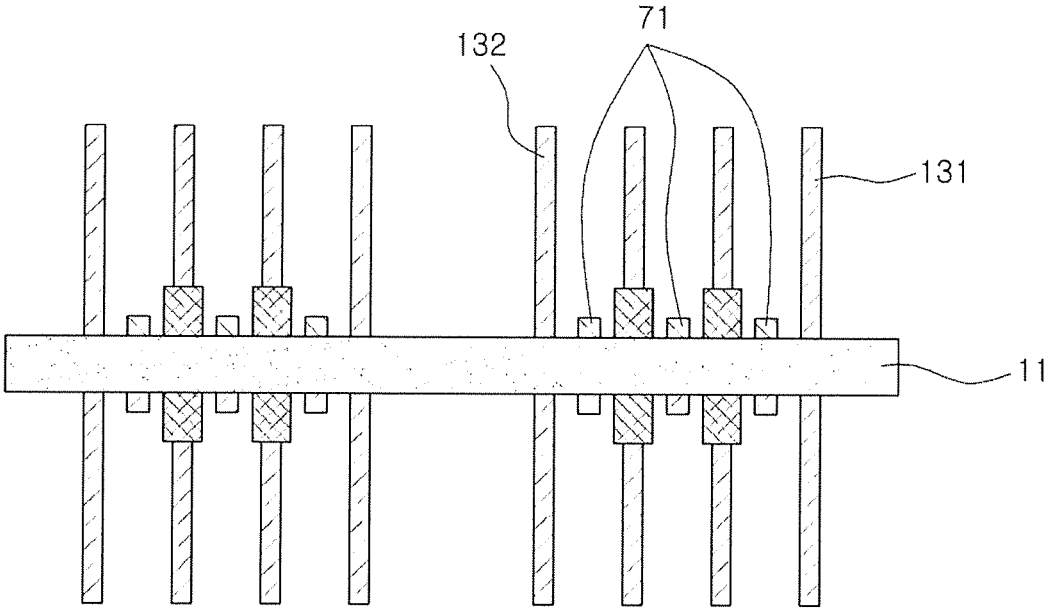

In FIG. 8F, a developing process may be performed on the primarily and secondarily exposed portions in FIGS. 8C and 8E. Resultantly, the shapes of the plurality of insulating patterns connected to each other may be derived. As shown in FIG. 8F, the central insulating patterns are divided into upper central insulating patterns and lower central insulating patterns on the basis of boundary surfaces. In addition, the insulating patterns may have a structure of an insulating wall with openings in which coil patterns to be described below may be filled.

Figure 8G:
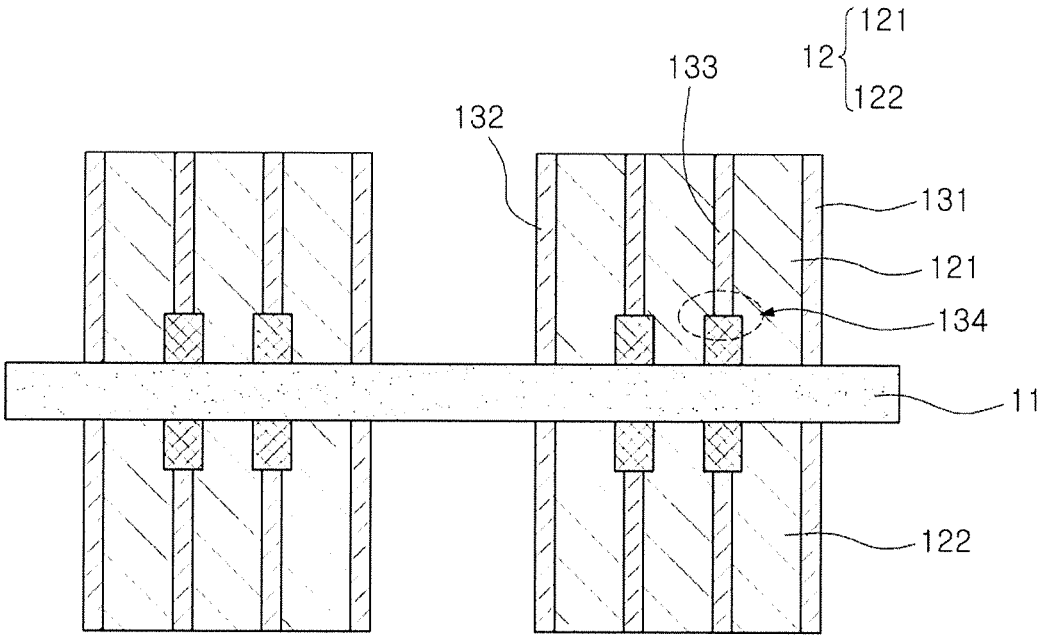

Referring to FIG. 8G, a copper electroplating process may be performed in the openings derived through the developing process of FIG. 8F. Empty spaces between the insulating patterns adjacent to each other are filled, such that the coil portion generally having the spiral shape may be derived. Although not illustrated, the upper coil patterns and the lower coil patterns may be electrically connected to each other through via electrodes filling via holes formed in the support member. The coil patterns having the high aspect ratio may be implemented through a copper electroplating process. The aspect ratio of the coil patterns may be appropriately designed by those skilled in the art, and an aspect ratio of upper surfaces of the coil patterns may be slightly lower than or substantially the same as that of upper surfaces of the insulating patterns adjacent to the coil patterns.

Figure 8H:
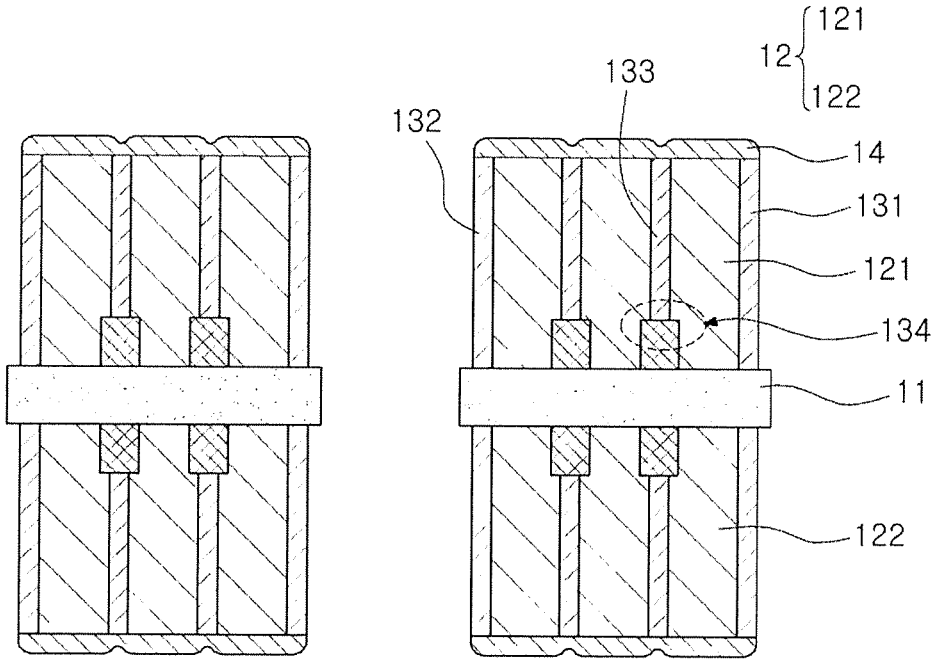

Referring to FIG. 8H, since the upper surfaces of the coil patterns are not protected by the insulating patterns, an insulation coating portion may be disposed in order to coat the upper surfaces of the coil patterns. The insulation coating portion may be disposed to prevent a short-circuit between adjacent coil patterns. The method of forming the insulation coating potion is not particularly limited, but may be, for example, a method of laminating an insulating sheet or a dipping method. In order to eliminate a height difference between the upper surfaces of the coil patterns and the upper surfaces of the insulating patterns, the insulation coating portion may be disposed after mechanical processing or chemical processing is optionally performed.

Figure 8I:
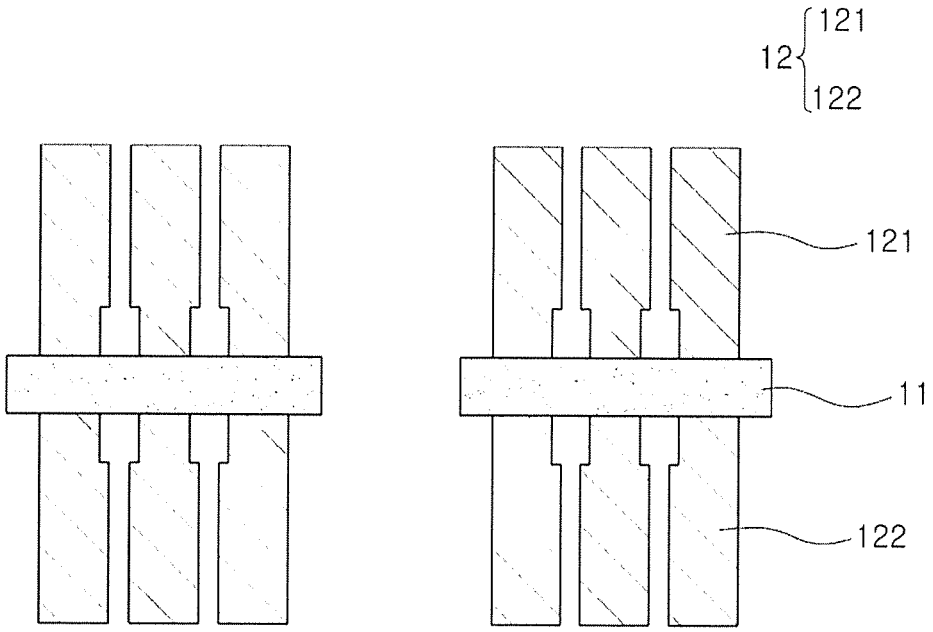

Since the coil electronic component illustrated in FIG. 4 does not separately include the insulation coating portion, a process of FIG. 8I may be performed after the copper electroplating process of FIG. 8G. Referring to FIG. 8I, a cavity process of removing the first and second resists may be performed. Resultantly, the insulating patterns disposed between the plurality of coil patterns may be removed, such that empty spaces may be formed between the plurality of coil patterns.

Figure 8J:
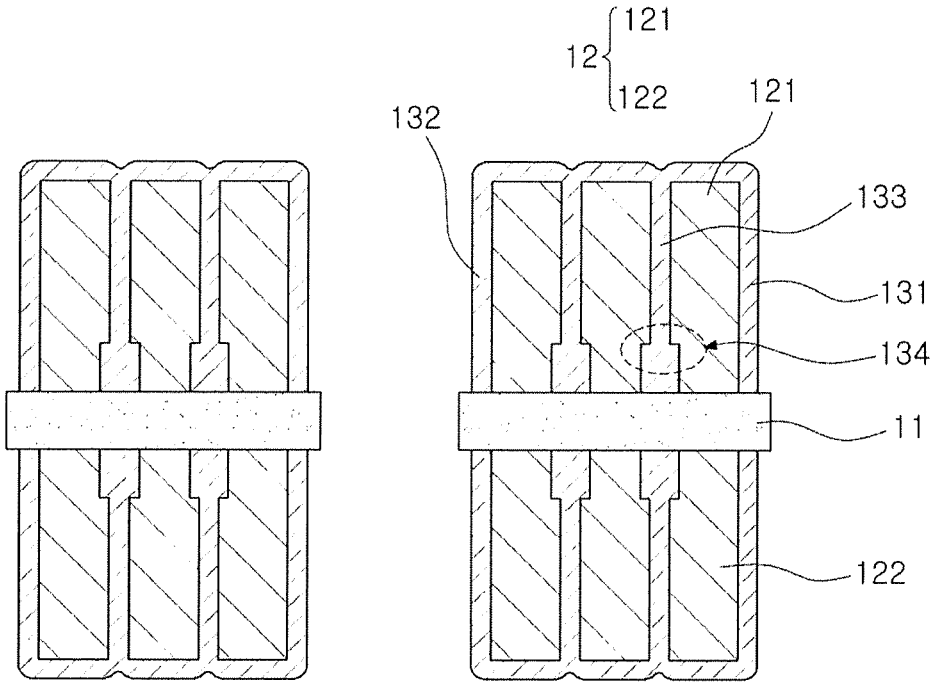

Referring to FIG. 8J, the insulating portion coating both of the side surfaces and the upper surfaces of the coil patterns may be formed. The method of forming the insulating portion is not limited, but may be a method of laminating an insulating sheet or a method of performing chemical vapor deposition on an insulating material showing an insulation property. The insulating material may be, for example, perylene, but is not limited thereto.

Although not illustrated in detail, a magnetic material formed of a composite of magnetic particles and a resin may be filled on the upper surface and the lower surface of the support member to constitute the appearance of the coil electronic component, lead portions of the coil patterns may be exposed through a dicing process, and external electrodes connected to the lead portions may be disposed, which are the same as processes of manufacturing a general chip.

An overlapping description for features of the coil electronic component according to the exemplary embodiment in the present disclosure described above has been omitted.

As set forth above, according to the exemplary embodiment in the present disclosure, a coil component having a high aspect ratio of at least 3:1 or more and including coil patterns stable in terms of a structure may be provided. Here, the coil patterns stable in terms of the structure refer to coil patterns between which a short-circuit is not generated and of which collapse or warpage is not generated.

While exemplary embodiments have been shown and described above, it will be apparent to those skilled in the art that modifications and variations could be made without departing from the scope of the present invention as defined by the appended claims.

What is claimed is:

1. A coil electronic component comprising:

a body including a plurality of coil patterns, a plurality of insulating patterns between adjacent coil patterns, an insulation coating portion in contact with upper surfaces of the coil patterns, and a support member supporting the coil patterns and the insulating patterns; and external electrodes on external surfaces of the body, wherein the plurality of insulating patterns includes an outermost insulating pattern, an innermost insulating pattern, and a plurality of central insulating patterns between the outermost insulating pattern and the innermost insulating pattern, at least one of the plurality of insulating patterns extends with a constant width over an entire thickness of the at least one insulating pattern, and one or more of the plurality of central insulating patterns has a variable width, in a cross-sectional view of a thickness direction, where the variable width of the one or more central insulating patterns is larger in a lower portion thereof that is in contact with the support member than in an upper portion thereof disposed above the lower portion, and wherein the at least one of the plurality of insulating patterns having the constant width and the one or more of the plurality of central insulating patterns having the variable width are alternately arranged on the support member in a winding direction.

2. The coil electronic component of claim 1, wherein the plurality of coil patterns include a plurality of upper coil patterns on an upper surface of the support member and a plurality of lower coil patterns on a lower surface of the support member, and the upper coil patterns and the lower coil patterns are electrically connected to each other by vias in the support member.

3. The coil electronic component of claim 1, wherein the one or more central insulating patterns each include a change portion between the upper and lower portions thereof, and the change portions each have boundary surfaces in the change portions.

4. The coil electronic component of claim 3, wherein a lower width of the one or more central insulating patterns below the boundary surfaces is larger than an upper width of the one or more central insulating patterns above the boundary surfaces.

5. The coil electronic component of claim 1, wherein the insulation coating portion extends across upper surfaces of the plurality of insulating patterns.

6. The coil electronic component of claim 1, wherein the one or more central insulating patterns each include a change portion between the upper and lower portions thereof, and an upper width of the one or more central insulating patterns is substantially constant above the change portions, and a lower width of the one or more central insulating patterns is substantially constant below the change portions.

7. The coil electronic component of claim 1, wherein the plurality of insulating patterns are connected to each other to form an insulating wall having a plurality of openings, the one or more central insulating patterns each include a change portion between the upper and lower portions thereof, and the change portions in the central insulating patterns are intermittently arranged in the insulating wall.

8. A coil electronic component comprising:

a support member;

a plurality of coil patterns supported by the support member and connected to each other; and insulating portions supported by the support member and coating side surfaces and upper surfaces of the coil patterns, wherein side surface insulating portions coating the side surfaces of the coil patterns are configured integrally with upper surface insulating portions coating the upper surface of the coil patterns, and the side surface insulating portions include one or more change portions, where the width of the side surface insulating portion changes so as to be largest at lower surfaces of the insulating portions where the side surface insulating portions are in contact with the support member, and one or more even portions, where the width of the side surface insulating portion is even over an entire thickness of the side surface insulating portion, and the one or more change portions and the one or more even portions are alternately arranged on the support member in a winding direction.

9. The coil electronic component of claim 8, wherein the insulating portions include upper insulating portions on an upper surface of the support member and lower insulating portions on a lower surface of the support member opposing the upper surface, and the change portions are in both of the upper insulating portions and the lower insulating portions.

10. The coil electronic component of claim 8, wherein the change portions are arranged in straight line sections of a coil portion of the plurality of coil patterns.

11. The coil electronic component of claim 8, further comprising a magnetic material encapsulating the insulating portions and the support member, wherein the magnetic material comprises a composite of magnetic particles and a resin.

12. The coil electronic component of claim 11, wherein connecting surfaces that connect the side surface insulating portions to the upper surface insulating portions have a curved shape.

13. The coil electronic component of claim 8, wherein the plurality of coil patterns include a plurality of upper coil patterns on an upper surface of the support member and a plurality of lower coil patterns on a lower surface of the support member opposing the upper surface, and the upper coil patterns and the lower coil patterns are electrically connected to each other by vias in the support member.

14. The coil electronic component of claim 13, further comprising a first external electrode connected to one end portion of an outermost coil pattern among the upper coil patterns and a second external electrode connected to one end portion of an outermost coil pattern among the lower coil patterns.

15. A coil electronic component comprising:

a support member, including a through-hole;

a coil disposed on a surface of the support member, the coil having a coil shape extending around the through-hole, and the coil comprising a plurality of coil patterns connected to each other, where adjacent coil patterns are spaced apart from each other in a cross-sectional view extending in a thickness direction orthogonal to the surface of the support member;

a plurality of insulating layers including:

an innermost insulating pattern on an inner side surface of the coil adjacent to the through-hole;

an outermost insulating pattern on an outer side surface of the coil on an outer peripheral side of the coil; and a plurality of central insulating patterns in between adjacent coil patterns of the coil, including:

one or more lower central insulating portions in contact with the support member and extending with a substantially constant first width in the thickness direction; and upper central insulating portions above the lower central insulating portions and extending with a substantially constant second width in the thickness direction;

an insulation coating portion on upper surfaces of the coil patterns and on upper surfaces of the central insulating patterns;

a magnetic body filling the through-hole and encapsulating the coil; and external electrodes on respective side surfaces of the magnetic body opposing each other in a length direction perpendicular to the thickness direction, wherein at least one of the plurality of central insulating patterns extends with a constant width over an entire thickness of the at least one of the plurality of central insulating patterns in the thickness direction, and at least another one of the plurality of central insulating patterns has a variable width, in which the first width is larger than the second width, in the thickness direction.

16. The coil electronic component of claim 15, wherein the innermost insulating pattern, the outermost insulating pattern, the plurality of central insulating patterns, and insulation coating portion are portions of an integrally configured insulation layer.

17. The coil electronic component of claim 15, wherein the one or more lower central insulating portions comprises a plurality of lower central insulating portions intermittently arranged along the length direction.

18. The coil electronic component of claim 15, wherein the plurality of central insulating patterns further include one or more change portions between the one or more lower central insulating portions and the upper central insulating portions, and wherein the change portions are abrupt change portions where the lower central insulating portion is in contact with the upper central insulating portion.

19. A coil electronic component comprising:

a support member;

a plurality of coil patterns supported by the support member and connected to each other; and insulating portions supported by the support member and coating side surfaces and upper surfaces of the coil patterns, wherein a width of a lower surface of one or more of the plurality of coil patterns is smallest where the coil patterns are in contact with the support member, and at least one of the plurality of coil patterns has a width that is smaller at a lower portion thereof in contact with the support member than at an upper portion thereof spaced away from the support member, and has a side surface that is orthogonal to the support member and is planar over an entire thickness of the at least one coil pattern in a direction orthogonal to the support member.

20. The coil electronic component of claim 19, wherein the one or more of the plurality of coil patterns include a change portion where a width changes.

21. The coil electronic component of claim 20, wherein a plurality of change portions, where the width of the one or more of the plurality of coil patterns changes, are intermittently arranged along the coil pattern.

22. The coil electronic component of claim 19, wherein the coil patterns include upper coil patterns on an upper surface of the support member and lower coil patterns on a lower surface of the support member opposing the upper surface, and change portions, where the width of the one or more of the plurality of coil patterns changes, are in both of the upper coil patterns and the lower coil patterns.

* * * * *